US005940982A

United States Patent [19]

Braun

[11] Patent Number: 5,940,982

[45] Date of Patent: Aug. 24, 1999

[54] PARTICULATE MATERIAL DRYER

[76] Inventor: Norman L. Braun, Box 718, Winkler, Manitoba, Canada, R6W 4A8

[21] Appl. No.: 09/130,368

[22] Filed: Aug. 7, 1998

[51] Int. Cl.[6] ..... F26B 17/12

[52] U.S. Cl. ..... 34/182; 34/174

[58] Field of Search ..... 34/168, 169, 171, 34/172, 174, 175, 181, 182

[56] References Cited

U.S. PATENT DOCUMENTS

| | | | |
|---|---|---|---|
| 4,398,356 | 8/1983 | Westelaken | 34/65 |
| 4,423,557 | 1/1984 | Westelaken | 34/573 |
| 4,914,834 | 4/1990 | Sime | 34/169 |

*Primary Examiner*—Henry Bennett
*Assistant Examiner*—Pamela A. Wilson
*Attorney, Agent, or Firm*—Adrian D. Battison; Murray E. Thrift

[57] ABSTRACT

A continuous flow particulate material dryer includes a base and a heating chamber extending upwards from a central location of the base for providing heated air to the dryer. A perforated inner wall structure extends upwardly from the base and surrounds the heating chamber. A perforated outer wall structure is spaced apart from the inner wall and extends upwardly from the base surrounding the inner wall. A main drying chamber is defined by the space between the inner and outer wall structures. A perforated partition separates the main drying chamber into an inner and an outer chamber. The partition restricts the flow of particulate material from the inner chamber and the outer chamber. An upward facing conical protrusion mounts above the heating chamber for dispersing the particulate matter evenly into both inner and outer chambers. A circular chamber having a rotatable auger therein is used to collect the particulate material from the base of the dryer. The auger includes ribbon flighting on an outermost portion for drawing particulate material from the outer chamber and full flighting on a remaining portion for drawing particulate material from the inner chamber. The full flighting draws the particulate material more quickly than the ribbon flighting, thus the particulate material flows through the inner chamber where the air is hotter at a faster rate than it flows through the outer chamber where the air is cooler to produce generally uniform drying.

4 Claims, 3 Drawing Sheets

HEAT SOURCE
10
12
13
14
15
16
18
20
22
24
26
28
30
32
34
36
38
40
42
44
46
48
50
52
54
56
58
59
60
61
4
4

PARTICULATE MATERIAL DRYER

FIELD OF THE INVENTION

This invention relates to continuous flow particulate material dryers and more particularly to a continuous flow dryer wherein the flow through the drying chamber of the dryer is divided.

BACKGROUND

After grain is harvested it is often stored before processing. It is desirable to dry the grain before storage because the moisture content of the freshly harvested grain may cause the grain to spoil in storage. This practice has long been known and many systems have been designed to accomplish this task.

In many known designs heated air is passed through a column of grain contained within perforated walls. The particulars of these designs vary greatly from simplified single pass or single stage systems to more complex multipass or multistage systems. The known prior art dryers are generally effective at drying grain however some drawbacks have been associated with these designs.

Some of the simpler systems do not address the common problem of non-uniform drying of the grain. With only one uniform flow column the grain closest to the heated air source is scorched while the grain furthest from the heated air source remains moist.

The complex systems generally address the problem of non-uniform grain drying however the systems require more than one pass or stage and therefore generally include more components. Resultantly the systems are more expensive and may require more maintenance.

U.S. Pat. No. 4,423,557 to Westlaken describes a two pass gravity flow grain dryer having columns with perforated walls for passing hot air through the grain therein. There is described a dividing wall extending between the walls of the columns for dividing a portion of the columns into two channels, wherein each of the channels contains a discharging mechanism. The dividing wall is limited however in the sense that it is not perforated and it is restricted to not divide the perforated section of the column. This does not adequately ensure that the grain passing through the perforated section will discharge through the appropriate channel and thus ensure uniform drying.

A continuous flow type grain dryer which provides a generally uniform drying of the grain while remaining a simplified single pass design would be a useful invention.

SUMMARY

According to a first aspect of the present invention there is provided a continuous flow particulate material dryer comprising:

a heating chamber centrally located within the dryer for providing heated air to the dryer;

an upright perforated inner wall structure surrounding the heating chamber;

an upright perforated outer wall structure spaced apart from and surrounding the inner wall structure;

a main drying chamber defined by a space between the inner and outer wall structures having an open upper end;

input means for receiving and distributing the particulate material evenly into the open upper end of the drying chamber;

a perforated partition wall extending the length of the main drying chamber between the inner and outer wall structures defining an inner drying chamber adjacent to the inner wall structure and an outer drying chamber adjacent to the outer wall structure;

wherein the partition restricts the flow of particulate material from the inner chamber to the outer chamber; and output means for removing the particulate material from the inner and outer chambers at different rates.

Preferably the input means comprises an upward facing conical protrusion mounted on the dryer above the heating chamber and a tubular sleeve mounted above the conical protrusion having an opening on a top end which receives the particulate material and an opening on a bottom end for depositing the particulate material onto the conical protrusion wherein the conical protrusion evenly distributes the particulate material to the open upper end of the drying chamber.

It is preferred that the output means comprises:

a circular chamber below the heating chamber connecting to a base of the inner and outer drying chambers;

a main auger extending radially outward from a central location of the circular chamber to the base of the inner and outer chambers for moving the particulate material from the base of the inner and outer chambers to the central location;

a support member mounted to the main auger for supporting the main auger within the circular chamber;

a wheel mounted to the support member for rotating the main auger about the central location;

ribbon flighting extending from an end portion of the auger directly below the outer chamber full flighting extending from a remaining portion of the auger for drawing the particulate material more quickly through the inner chamber than through the outer chamber;

a channel leading from the central location to a location adjacent to the dryer;

a secondary auger rotating within the channel for removing the particulate material from the central location to the location adjacent to the dryer; and an airlock mounted on an outward end of the channel for preventing the escape of hot air needed to dry the particulate material.

According to a second aspect of the invention there is provided a continuous flow particulate material dryer comprising:

a heating chamber centrally located within the dryer for providing heated air to the dryer;

an upright perforated inner wall structure surrounding the heating chamber;

an upright perforated outer wall structure spaced apart from and surrounding the inner wall structure;

a main drying chamber defined by the space between the inner and outer wall structures having an open upper end;

an upward facing conical protrusion mounted on the dryer above the heating chamber;

a tubular sleeve mounted above the conical protrusion having an opening on a top end which receives the particulate material and an opening on a bottom end for depositing the particulate material onto the conical protrusion;

wherein the conical protrusion evenly distributes the particulate material to the open upper end of the drying chamber;

a perforated partition wall extending the length of the main drying chamber between the inner and outer wall structures defining an inner drying chamber adjacent to the inner wall structure and an outer drying chamber adjacent to the outer wall structure;

wherein the partition restricts the flow of particulate material from the inner chamber to the outer chamber;

a circular chamber below the heating chamber connecting to a base of the inner and outer drying chambers;

a main auger extending radially outward from a central location of the circular chamber to the base of the inner and outer chambers for moving the particulate material from the base of the inner and outer chambers to the central location;

a support member mounted to the main auger for supporting the main auger within the circular chamber;

a wheel mounted to the support member for rotating the main auger about the central location;

ribbon flighting extending from an end portion of the auger directly below the outer chamber;

full flighting extending from a remaining portion of the auger for drawing the particulate material more quickly through the inner chamber than through the outer chamber;

a channel leading from the central location to a location adjacent to the dryer;

a secondary auger rotating within the channel for removing the particulate material from the central location to the location adjacent to the dryer; and an airlock mounted on an outward end of the channel for preventing the escape of hot air needed to dry the particulate material.

BRIEF DESCRIPTION OF THE DRAWINGS

In the accompanying drawings, which illustrate an exemplary embodiment of the present invention.

DETAILED DESCRIPTION

Figure 1:
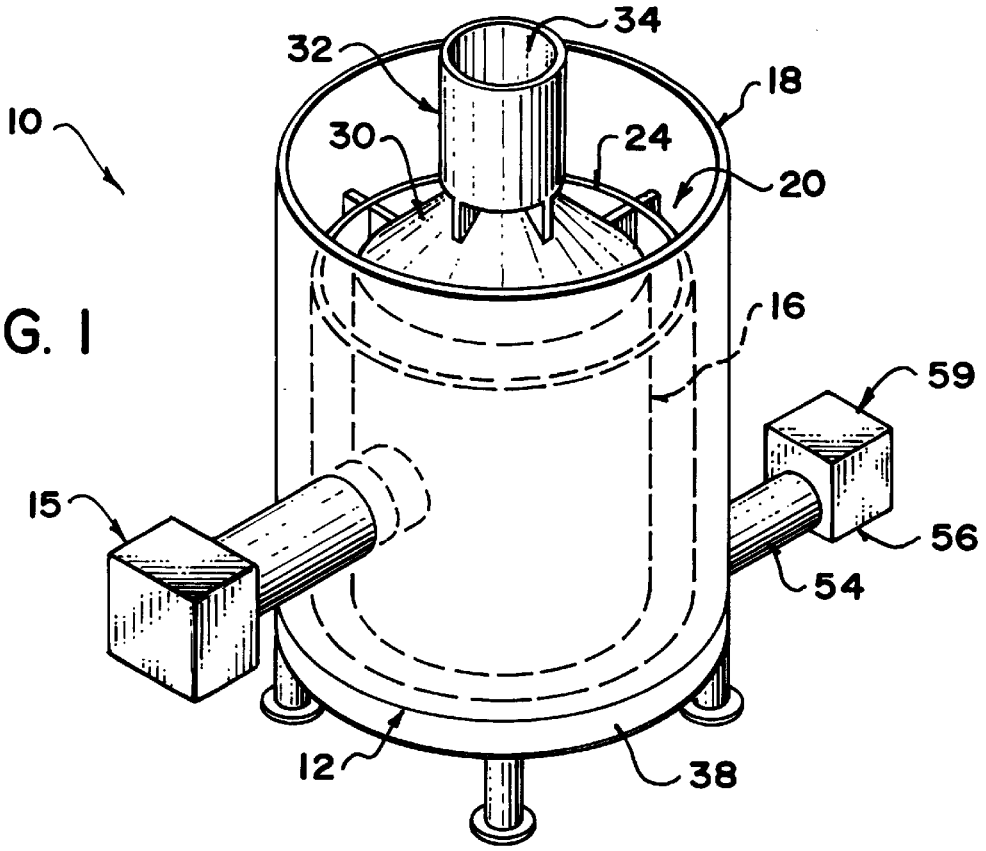
FIG. 1 is an isometric view showing the top and one side of the dryer.
Figure 3:
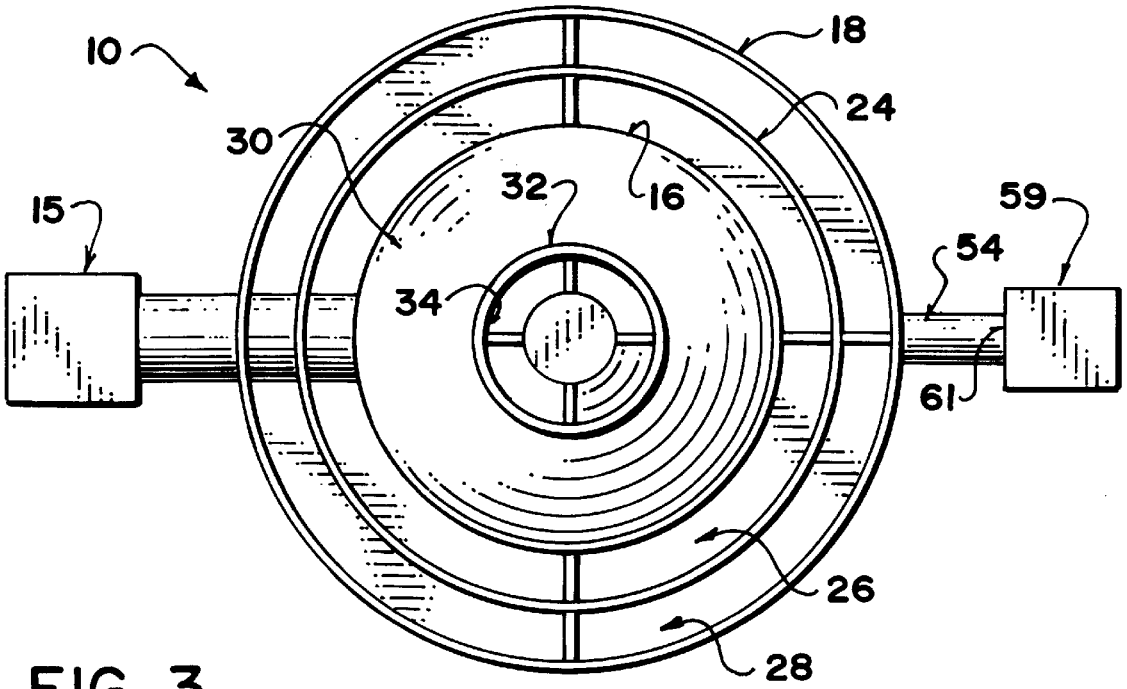
FIG. 3 is a top plan view of the dryer.
Figure 2:
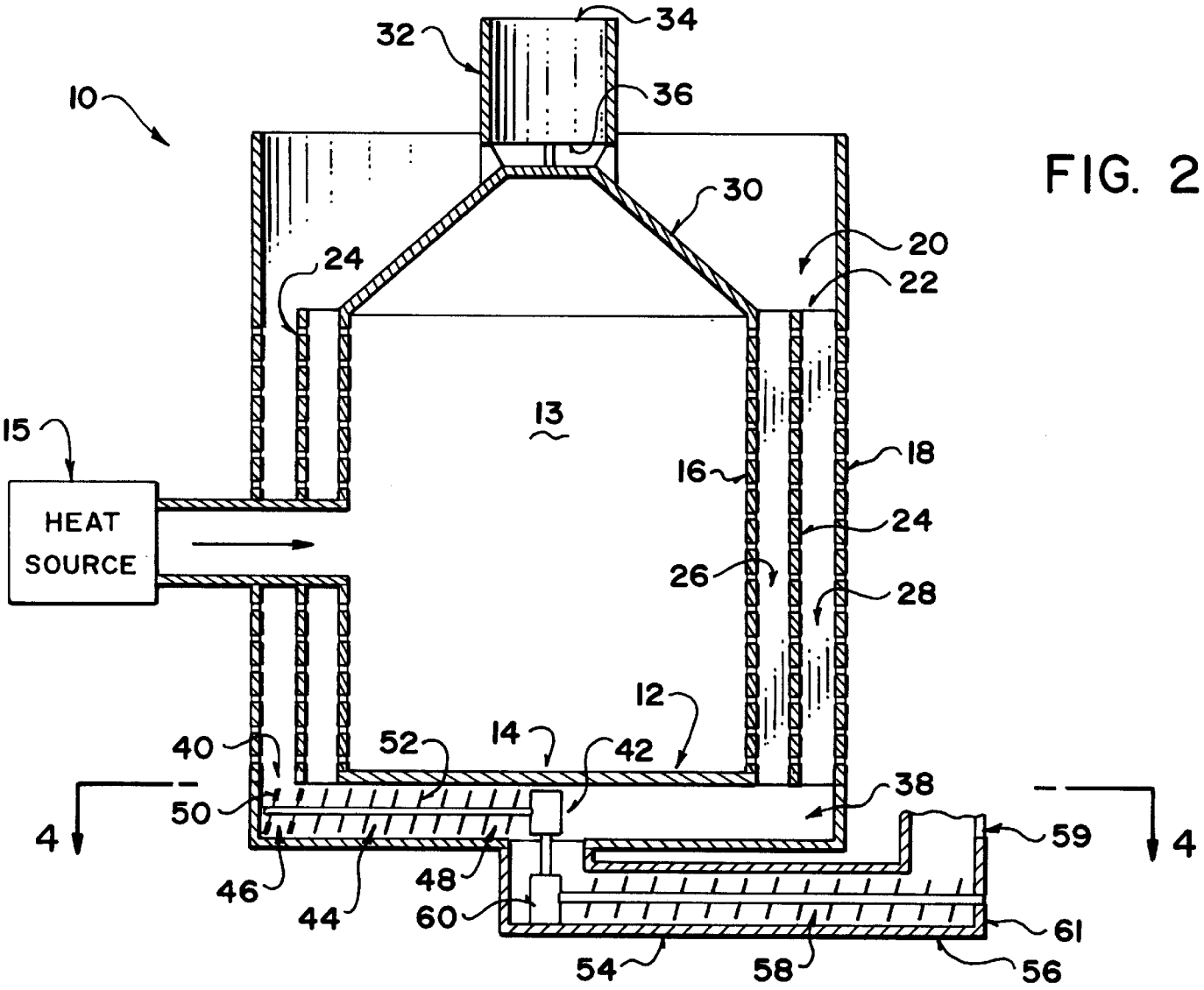
FIG. 2 is a side cross-sectional view of the dryer.
Figure 4:
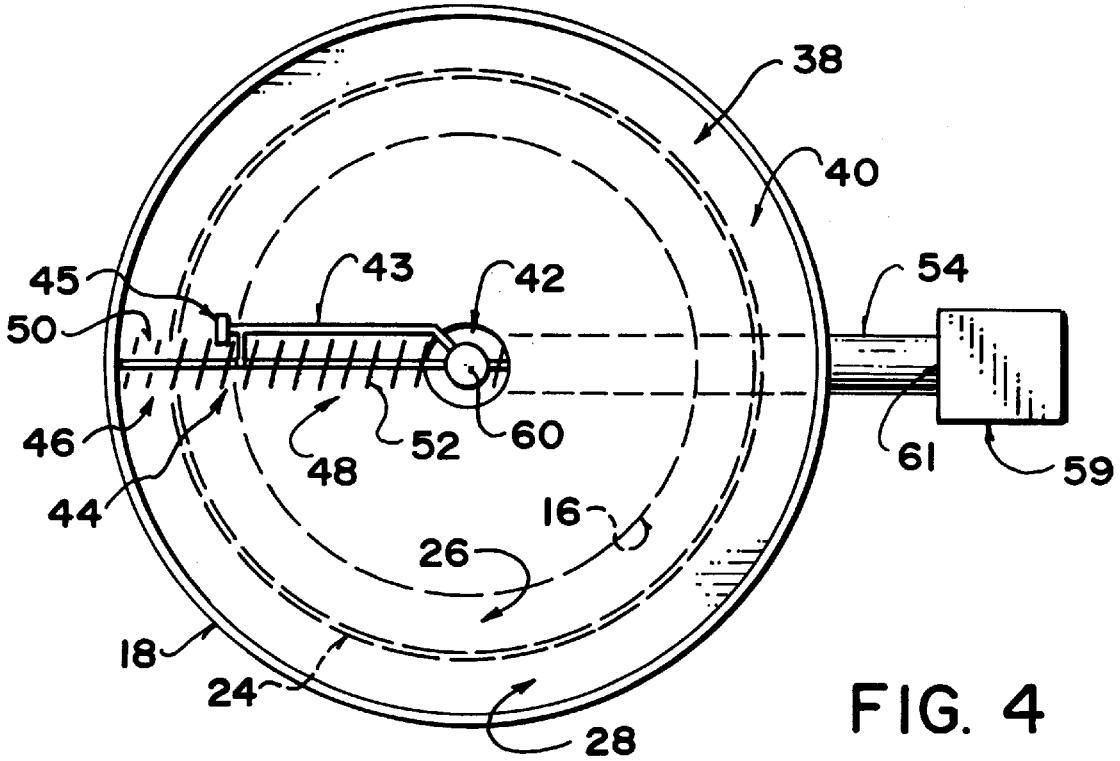
FIG. 4 is a cross sectional view of the dryer along line 4—4 of FIG. 2 showing the output mechanism.

Referring to the accompanying drawings, there is illustrated a continuous flow grain dryer generally indicated by the number 10. The grain dryer 10 includes a base portion 12 for mounting the components of the dryer. A heating chamber 13 extends upwardly from a central location 14 of the base 12 for providing heated air from a supply source 15 to the dryer 10.

A perforated inner wall structure 16 extends upwardly from the base 12 and surrounds the heating chamber 13. A perforated outer wall structure 18 extends upwardly from the base 12 wherein the outer wall structure is spaced apart from and surrounds the inner wall structure 16. A main drying chamber 20 is defined by the space between the inner 16 and outer 18 wall structures. The main chamber 20 has an open upper end 22 for receiving grain.

A perforated partition wall 24 extends upwards from the base 12 between the inner and outer wall structures 16, 18 up to the open upper end 22 of the dryer chamber 20. The partition 24 defines an inner drying chamber 26 adjacent to the inner wall 16 and an outer drying chamber 28 adjacent to the outer wall 18. The partition 24 restricts the flow of grain from the inner chamber 26 to the outer chamber 28.

An upward facing conical protrusion 30 is mounted on the dryer 10 above the heating chamber 13. A tubular sleeve 32 is mounted above the conical protrusion 30. The sleeve 32 has an open top end 34 for receiving the grain and an open bottom end 36 for depositing the grain onto the conical protrusion 30. The conical protrusion 30 evenly distributes the deposited grain to the open upper end 22 of the drying chamber 20.

A circular chamber 38 below the heating chamber 13 collects the grain from a base of the inner and outer chambers 40. A main auger 44 extends radially outward from a central location 42 of the circular chamber 38 for moving the particulate material from the base of the inner and outer chambers 40 to the central location 42.

A support member 43 is mounted to the main auger 44 for supporting the main auger within the circular chamber 38. A wheel 45 is mounted to the support member 43 for rotating the main auger 44 about the central location 42.

The main auger 44 includes an end portion 46 directly below the outer chamber 28 and a remaining portion 48 extending from the inner chamber 26 to the central location 42. Ribbon flighting 50 extends from the end portion 48 of the main auger 44 while full flighting 52 extends from the remaining portion 48. The full flighting 52 draws grain more quickly from the inner chamber 26 than the ribbon flighting 50 draws from the outer chamber 28.

Thus the inner and outer chambers 26, 28 are arranged such that the grain is passed through the inner chamber 26 close to the heat source quickly so the grain is not scorched while the grain in the outer chamber 28 passes slowly so that it will be properly dried even though it is much further from the heat source. This produces generally uniform drying in a continuous single pass dryer system.

A channel 54 leads from the central location 42 to a location adjacent to the dryer 56. A secondary auger 58 rotates within the channel 54 for moving the grain from the central location 42 to the location adjacent to the dryer 56. An airlock 59 is mounted on an outward end 61 of the channel 54 for preventing the escape of hot air needed to dry the grain. The augers 44 and 58 are driven by a drive system 60.

Figure 5:
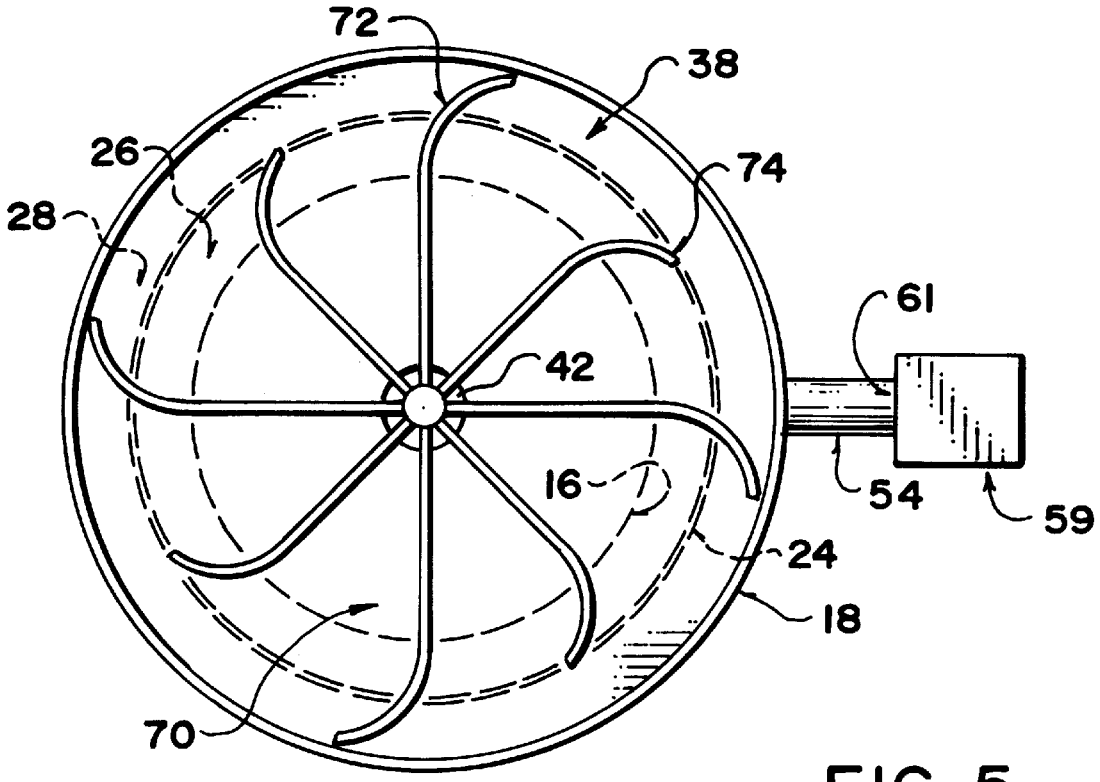
FIG. 5 is a cross sectional view similar to FIG. 4 showing a further embodiment of the dryer output mechanism.

In another embodiment of the invention shown in FIG. 5, the grain may be collected from the circular chamber 38 to the central location 42 by a set of scoops 70. These scoops include long scoops 72 extending from the central location 42 to the outer wall 18 as well as short scoops 74 extending from the central location 42 to the partition wall 24. In this arrangement the scoops are rotated about the central location 42 such that the long scoops 72 collect grain from the inner and outer chambers 26, 28 while the short scoops 74 only collect grain from the inner chamber 26. Thus the grain is passed through the inner chamber close to the heat source at a faster rate for producing generally uniform drying.

In a further embodiment of invention the grain dryer may be rectangular in cross-section. In this embodiment each side of the dryer includes its own set of augers for collecting the grain from the inner and outer chambers.

While a few embodiments of the present invention have been described in the foregoing, it is to be understood that other embodiments are possible within the scope of the invention. The invention is to be considered limited solely by the scope of the appended claims.

I claim:

1. A continuous flow particulate material dryer comprising:

a heating chamber centrally located within the dryer for providing heated air to the dryer;

an upright perforated inner wall structure surrounding the heating chamber;

an upright perforated outer wall structure spaced apart from and surrounding the inner wall structure;

a main drying chamber defined by a space between the inner and outer wall structures having an open upper end;

input means for receiving and distributing the particulate material evenly into the open upper end of the drying chamber;

a perforated partition wall extending the length of the main drying chamber between the inner and outer wall structures defining an inner drying chamber adjacent to the inner wall structure and an outer drying chamber adjacent to the outer wall structure;

wherein the partition restricts the flow of particulate material from the inner chamber to the outer chamber; and output means for removing the particulate material from the inner and outer chambers at different rates.

2. The dryer of claim 1 wherein the input means comprises an upward facing conical protrusion mounted on the dryer above the heating chamber and a tubular sleeve mounted above the conical protrusion having an opening on a top end which receives the particulate material and an opening on a bottom end for depositing the particulate material onto the conical protrusion wherein the conical protrusion evenly distributes the particulate material to the open upper end of the drying chamber.

3. The dryer of claim 1 wherein the output means comprises:

a circular chamber below the heating chamber connecting to a base of the inner and outer drying chambers;

a main auger extending radially outward from a central location of the circular chamber to the base of the inner and outer chambers for moving the particulate material from the base of the inner and outer chambers to the central location;

a support member mounted to the main auger for supporting the main auger within the circular chamber;

a wheel mounted to the support member for rotating the main auger about the central location;

ribbon flighting extending from an end portion of the auger directly below the outer chamber;

full flighting extending from a remaining portion of the auger for drawing the particulate material more quickly through the inner chamber than through the outer chamber;

a channel leading from the central location to a location adjacent to the dryer;

a secondary auger rotating within the channel for removing the particulate material from the central location to the location adjacent to the dryer; and an airlock mounted on an outward end of the channel for preventing the escape of hot air needed to dry the particulate material.

4. A continuous flow particulate material dryer comprising:

a heating chamber centrally located within the dryer for providing heated air to the dryer;

an upright perforated inner wall structure surrounding the heating chamber;

an upright perforated outer wall structure spaced apart from and surrounding the inner wall structure;

a main drying chamber defined by a space between the inner and outer wall structures having an open upper end;

an upward facing conical protrusion mounted on the dryer above the heating chamber;

a tubular sleeve mounted above the conical protrusion having an opening on a top end which receives the particulate material and an opening on a bottom end for depositing the particulate material onto the conical protrusion;

wherein the conical protrusion evenly distributes the particulate material to the open upper end of the drying chamber;

a perforated partition wall extending the length of the main drying chamber between the inner and outer wall structures defining an inner drying chamber adjacent to the inner wall structure and an outer drying chamber adjacent to the outer wall structure;

wherein the partition restricts the flow of particulate material from the inner chamber to the outer chamber;

a circular chamber below the heating chamber connecting to a base of the inner and outer drying chambers;

a main auger extending radially outward from a central location of the circular chamber to the base of the inner and outer chambers for moving the particulate material from the base of the inner and outer chambers to the central location;

a support member mounted to the main auger for supporting the main auger within the circular chamber;

a wheel mounted to the support member for rotating the main auger about the central location;

ribbon flighting extending from an end portion of the auger directly below the outer chamber;

full flighting extending from a remaining portion of the auger for drawing the particulate material more quickly through the inner chamber than through the outer chamber;

a channel leading from the central location to a location adjacent to the dryer;

a secondary auger rotating within the channel for removing the particulate material from the central location to the location adjacent to the dryer; and an airlock mounted on an outward end of the channel for preventing the escape of hot air needed to dry the particulate material.

* * * * *